US008317190B2

(12) United States Patent
Masotta et al.

(10) Patent No.: US 8,317,190 B2
(45) Date of Patent: Nov. 27, 2012

(54) HIGH THROUGHPUT RIGHT ANGLE TURN MODULE

(75) Inventors: John R. Masotta, Bethel, CT (US); Robert E. Manna, Newtown, CT (US); Daniel J. Williams, Woodbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 1809 days.

(21) Appl. No.: 11/296,620

(22) Filed: Dec. 7, 2005

(65) Prior Publication Data

US 2007/0126175 A1 Jun. 7, 2007

(51) Int. Cl.
*B65H 5/00* (2006.01)

(52) U.S. Cl. ..... 271/225; 271/254; 271/265.01

(58) Field of Classification Search ..... 271/225, 271/9.13, 253, 254, 265.01, 176, 184; 198/437, 198/457.03, 597
See application file for complete search history.

(56) References Cited

U.S. PATENT DOCUMENTS

| | | | | |
|---|---|---|---|---|
| 4,724,945 | A * | 2/1988 | Martin | 198/412 |
| 5,180,154 | A | 1/1993 | Malick | |
| 5,188,355 | A | 2/1993 | Lowell et al. | |
| 5,205,551 | A * | 4/1993 | Nagano et al. | 271/225 |
| 5,421,662 | A * | 6/1995 | Magee | 270/1.01 |
| 5,538,239 | A | 7/1996 | Auerbach et al. | |
| 5,538,240 | A | 7/1996 | Auerbach et al. | |
| 5,641,158 | A | 6/1997 | Gelb et al. | |
| 5,649,698 | A | 7/1997 | Auerbach et al. | |
| 5,664,772 | A | 9/1997 | Auerbach | |
| 6,102,391 | A * | 8/2000 | Malick et al. | 271/225 |
| 6,378,861 | B1 * | 4/2002 | Middelberg et al. | 271/225 |
| 6,443,447 | B1 | 9/2002 | Ifkovits et al. | |
| 6,554,274 | B2 * | 4/2003 | Middelberg et al. | 271/225 |
| 6,557,847 | B2 * | 5/2003 | Middelberg et al. | 271/225 |
| 6,659,445 | B2 | 12/2003 | Boss | |
| 6,715,755 | B2 | 4/2004 | Sussmeier | |

FOREIGN PATENT DOCUMENTS

| | | |
|---|---|---|
| JP | 2000007202 | 1/2000 |
| WO | 0142116 A2 | 6/2001 |

* cited by examiner

*Primary Examiner* — Michael McCullough
(74) *Attorney, Agent, or Firm* — Brian A. Collins; Charles R. Malandra, Jr.; Steven J. Shapiro

(57) ABSTRACT

A right angle turn module having a first transport that transports side-by-side sheets in a first direction. Downstream of the first sheet transport a barrier is positioned to stop the sheets. A sensor device detects an arrival of the side-by-side sheets at the stop arrangement. Then, an actuated second sheet transport, triggered by the sensor device, is activated to transport the sheets serially in a second direction substantially perpendicular to the first direction. In a preferred embodiment, a horizontal guide plate is positioned at a downstream end of the first sheet transport. With the guide plate thus positioned, a sheet traveling in the first direction and a sheet traveling in the second direction can temporarily be overlapped and a collision can be avoided. In a further preferred embodiment, the first transport further comprises overhead belts to urge the side-by-side pair of sheets in the first direction. The overhead belts may be tensioned so as to slip over a top surface of the side-by-side pair of sheets while urging the pair of sheets towards the stop arrangement.

28 Claims, 11 Drawing Sheets

HIGH THROUGHPUT RIGHT ANGLE TURN MODULE

TECHNICAL FIELD

The present invention relates to a right angle turn module for redirecting and reorienting sheets by ninety degrees.

BACKGROUND OF THE INVENTION

Inserter systems, such as those applicable for use with the present invention, are typically used by organizations such as banks, insurance companies and utility companies for producing a large volume of specific mailings where the contents of each mail item are directed to a particular addressee. Also, other organizations, such as direct mailers, use inserts for producing a large volume of generic mailings where the contents of each mail item are substantially identical for each addressee. Examples of such inserter systems are the 8 series, 9 series, and APS™ inserter systems available from Pitney Bowes Inc. of Stamford Conn.

In many respects, the typical inserter system resembles a manufacturing assembly line. Sheets and other raw materials (other sheets, enclosures, and envelopes) enter the inserter system as inputs. Then, a variety of modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

The input stages of a typical inserter system are depicted in FIG. 1. At the input end of the inserter system, rolls or stacks of continuous printed documents, called a "web," are fed into the inserter system by a web feeder 100. The continuous web must be separated into individual document pages. This separation is typically carried out by a web cutter 200 that cuts the continuous web into individual document pages. Downstream of the web cutter 200, a right angle turn 300 may be used to reorient the documents, and/or to meet the inserter user's floor space requirements.

The cut pages must subsequently be accumulated into collations corresponding to the multi-page documents to be included in individual mail pieces. This gathering of related document pages occurs in the accumulator module 400 where individual pages are stacked on top of one another.

The control system for the inserter senses markings on the individual pages to determine what pages are to be collated together in the accumulator module 400. In a typical inserter application, mail pieces may include varying number of pages to be accumulated. When a document accumulation is complete, then the accumulation is discharged as a unit from the accumulator 400.

Downstream of the accumulator 400, a folder 500 typically folds the accumulation of documents to fit in the desired envelopes. To allow the same inserter system to be used with different sized mailings, the folder 500 can typically be adjusted to make different sized folds on different sized paper.

Downstream of the folder 500, a buffer transport 600 transports and stores accumulated and folded documents in series in preparation for transferring the documents to the synchronous inserter chassis 700. By lining up a backlog of documents in the buffer 600, the asynchronous nature of the upstream accumulator 400 will have less impact on the synchronous inserter chassis 700. On the inserter chassis 700 inserts are added to the folded accumulation prior to insertion into an envelope at a later module.

SUMMARY OF THE INVENTION

An improved right angle turn allows high speed, high throughput processing of sheets cut from a web in portrait orientation, and subsequently processed in landscape orientation. Existing modules do the job, but require large gaps between sheets entering from the cutter (portrait) and exiting the module (landscape) in order to avoid collisions. Other higher speed methods require two distinct paper paths to eliminate the jam condition. These two path methods tend to be costlier, more difficult to operate, and less reliable.

The new design uses high processing speeds (about 300 inches per second ("ips")), as well as high speed, two-up guillotine cutters. The proposed right angle turn module is capable of processing up to 72,000 sheets of 8.5"×11" size per hour. In addition, the design merges two distinct side-by-side paper paths with a single set of drive elements to alleviate paper path collisions while allowing maximum throughput.

In the improved design, a first sheet transport transports at least two side-by-side sheets in a first direction. Downstream of the first sheet transport, a barrier is positioned to stop the travel of the two side-by-side sheets in the first direction. A sensor device detects an arrival of the side-by-side sheets at the stop arrangement. Then, an actuated second sheet transport, triggered by the sensor device, is activated to transport the sheets serially in a second direction substantially perpendicular to the first direction.

In a preferred embodiment, a horizontal guide plate is positioned at a downstream end of the first sheet transport, in a path of at least the side-by-side sheet on a downstream side in the second direction. With the guide plate thus positioned, a sheet traveling in the first direction will pass over the guide plate on its way to the stop arrangement. Then, when the sheets are being transported serially in the second direction, the downstream serial sheet will pass over the guide plate in the second direction and the upstream serial sheet will pass under the guide plate in the second direction. In such an embodiment, a second pair of sheets may approach the barrier in the first direction, while the first pair is still leaving the right angle turn in the perpendicular direction. The horizontal guide plate allows an incoming sheet to pass on top of the guide plate, while an outgoing sheet is still underneath the guide plate. Thus collisions between incoming and outgoing sheets are avoided, and less spacing is required between sets of sheets. In essence, the thin guide plate separates one paper path into two in order to avoid collisions between successive pairs of sheets.

In a further preferred embodiment, the first transport further comprises overhead belts positioned at least above the guide plate to urge the side-by-side pair of sheets in the first direction. The overhead belts may be tensioned so as to slip over a top surface of the side-by-side pair of sheets while urging the pair of sheets towards the stop arrangement. The overhead belts can operate continuously, and can operate to align serial sheets towards the stop, even while sheets are traveling perpendicular to the direction of the belts while traveling in the second direction. Also, the overhead flat belts operate to dissipate energy from the sheets as they collide with the wall.

The right angle turn module may further include an upwardly biased plate proximal to the horizontal guide plate. A sheet traveling in the first direction will pass over the upwardly biased plate on its way to the stop arrangement. The biased plate provides an upward spring force to press the sheet with a normal force into contact with the overhead belts.

Another preferred feature of the improved right angle turn is an overhead ceiling arrangement positioned above a paper path immediately upstream, in the first direction, of the stop arrangement barrier. The ceiling arrangement helps guide sheets transported by the first and second transports, and prevents the sheets from buckling when the sheets impact with the stop arrangement.

The stop arrangement may include an adjustable back wall that is adjustable in the first direction to accommodate different sized sheets. Because the sensor device may stay in one location the timing for actuating the second transport is adjusted accordingly to account for the repositioning of the adjustable wall.

Further details of the present invention are provided in the accompanying drawings, detailed description and claims.

DETAILED DESCRIPTION

Figure 1:
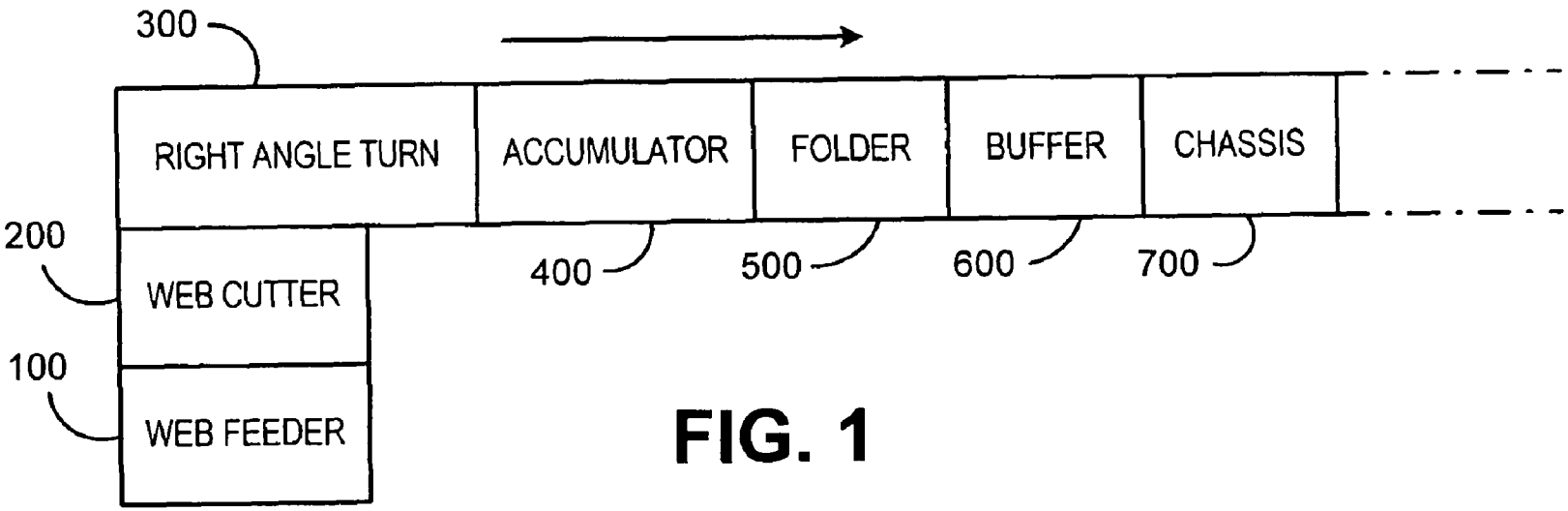
FIG. 1 is a diagram of the input stages of an inserter system for use with the present invention.
Figure 2:
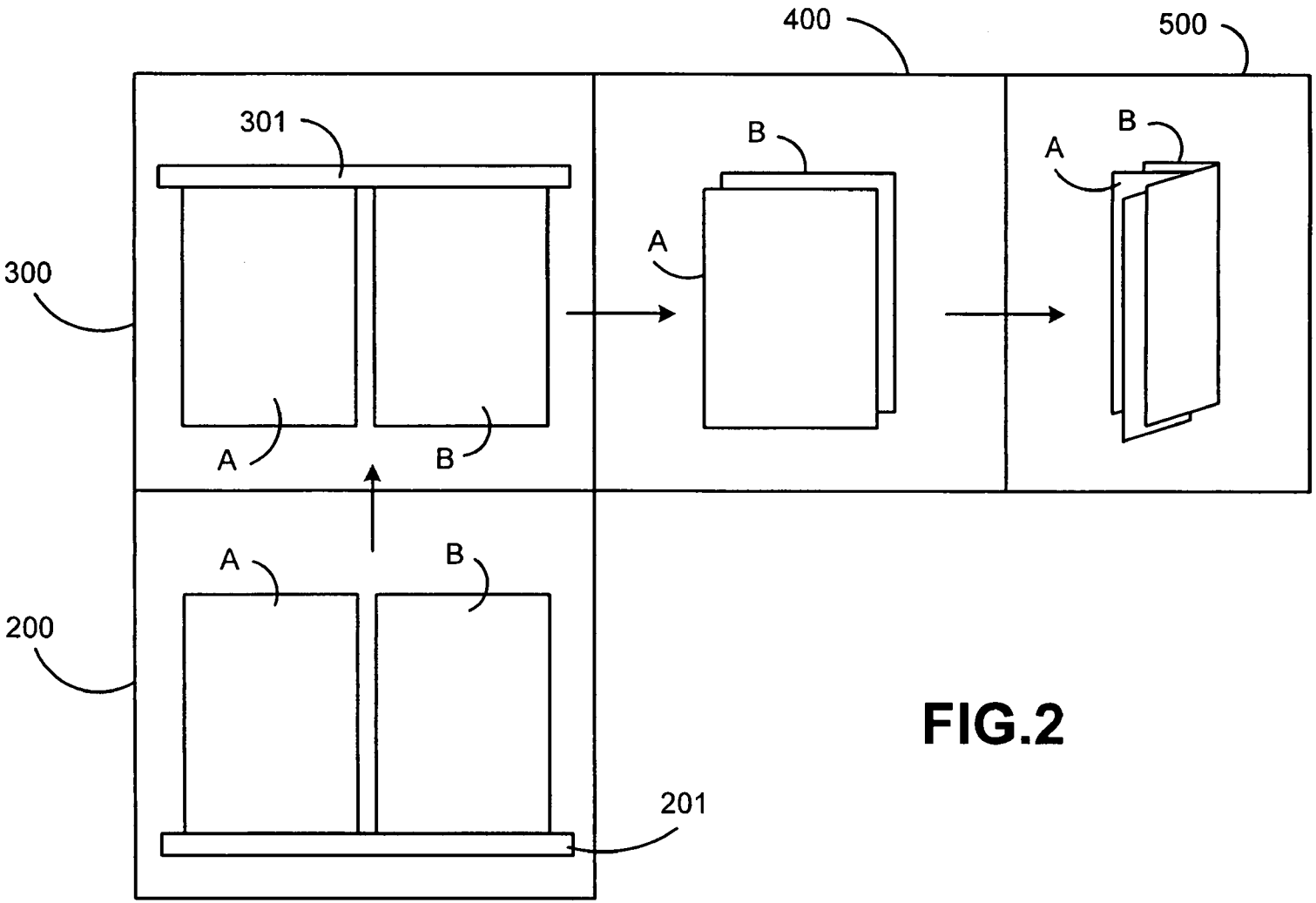
FIG. 2 depicts a generic arrangement of a right angle turn in combination with an accumulator and folder.

FIG. 2 depicts a flow of sheets through a generic right angle turn module 300. In this example, the web cutter module 200 with cutter blade 201 cuts sheets A and B transported in a side-by-side "portrait" orientation. In right angle turn module 300 sheets A and B are stopped by a barrier 301 prior to be transported away at right angle. When being transported out of the right angle turn module 300, the sheets are arranged serially and are considered to be traveling in a "landscape" orientation. The landscape sheets are then accumulated in the accumulator 400 and folded along their length in the folder 500. This arrangement and folding of sheets shown in FIG. 2 is popular for use with financial services statements, and is sometimes referred to as a "broker fold."

Figure 3:
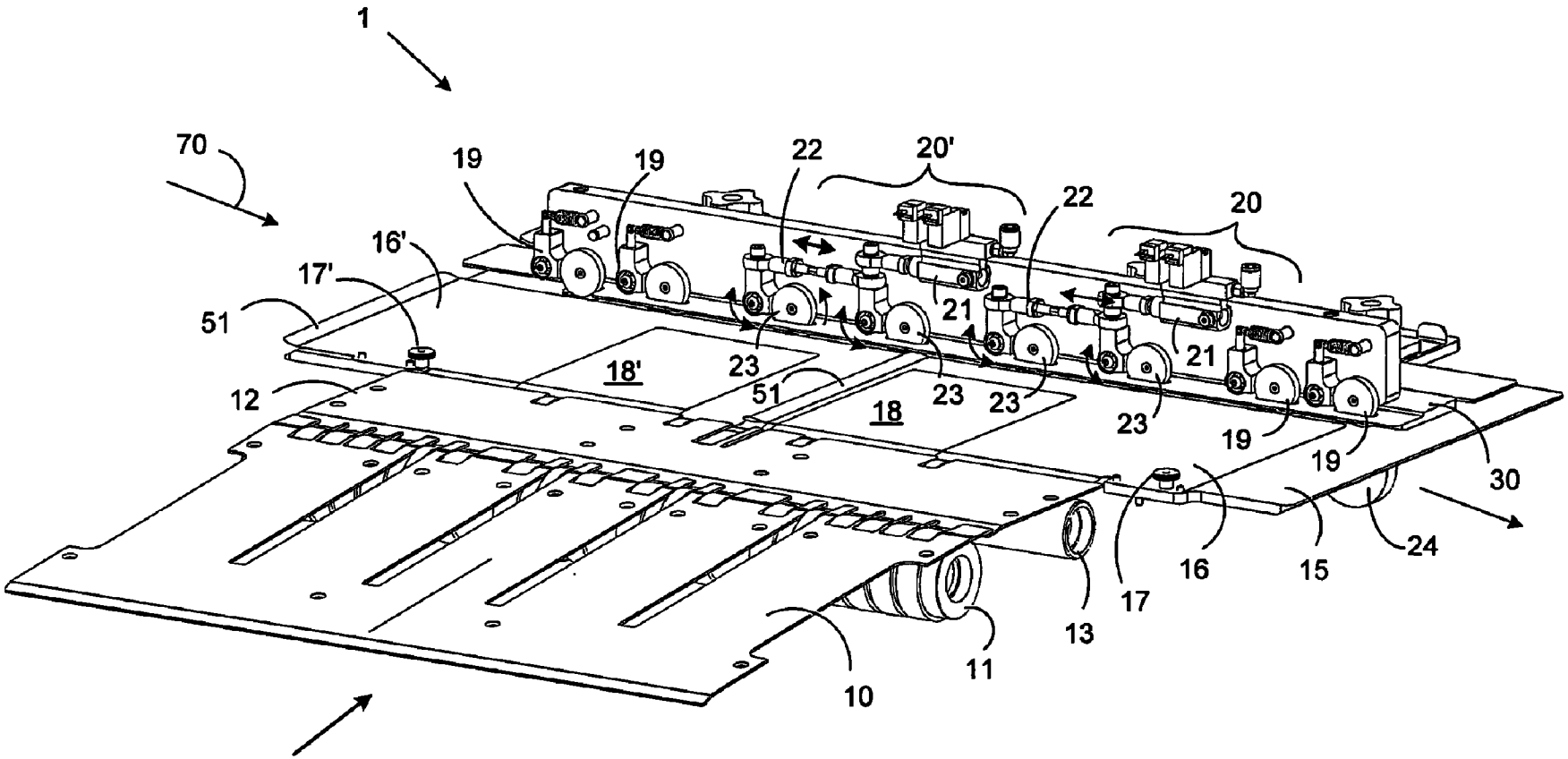
FIG. 3 is an isometric view of an improved right angle turn module, with some upper components removed in order to view the paper path.
Figure 4:
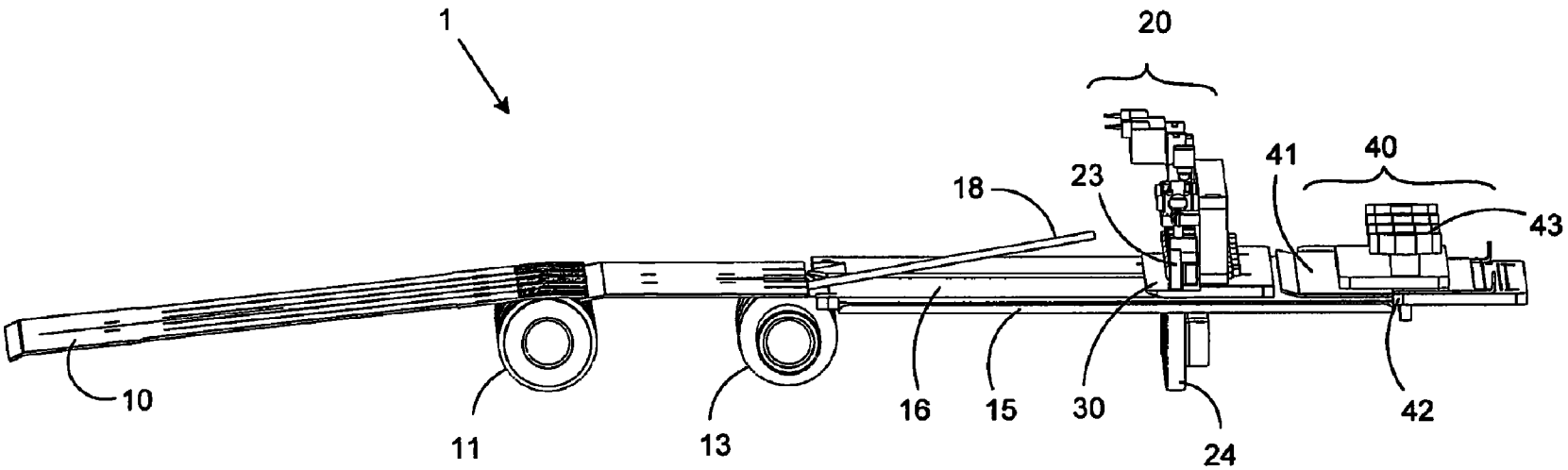
FIG. 4 is an isometric view of the right angle turn module shown in FIG. 3 from a different angle.

FIGS. 3, 4, 10 and 11 depict structural and transport components of the improved right angle turn module 1. In FIGS. 3 and 4, an upper transport assembly 50 is not shown, so that the paper path can be more easily seen.

Prior to processing in the right angle turn module 1, a web of paper is loaded into the cutter module 200. The cutter 200 slits, trims, and cuts the web into discrete sheets of appropriate size. For a two-up application, each cut yields two side-by-side sheets. Traveling into the right angle turn module 1 the sheets are traveling evenly with each other. For purposes of this description the sheets are differentiated based on their relative positions after the right angle turn. The first sheet to be processed downstream after the right angle turn is referred to as the "lead sheet." The "trail sheet" is the other one of the pair that follows upstream of the lead sheet. In the examples and figures depicted herein, sheets are depicted as taking a right turn at the right angle turn module 1. Accordingly, in these examples the right sheet will be the lead sheet and the left sheet will be the trail sheet. It will be understood that the invention is equally applicable to a left turn module.

For purposes of this description a "nip" should be understood to comprise a pair of rollers that positively engages a sheet in order to drive it. A nip is typically made from a pair of rollers, and the nip will be identified herein by the corresponding reference numbers that identify the two rollers.

As seen in FIGS. 3, 4, 10 and 11, an inclined deck 10 forming the input path of the right angle turn 1 is angled upward. Elastic flat belts 53 overrun and guide the sheets as they enter the adjustable nips 54, 60. Two photocells 63 are positioned over each paper path just downstream of the adjustable nips 54, 60 to begin tracking of the sheets. The photocells 63 do not adjust with the nips, so for shorter sheets, transition will happen later (in time) than with longer sheets. The transition will take place at the same physical place for the leading edge, regardless of sheet length.

A second set 55, 11 and third set 56, 13 of hard nips accept the paper from the adjustable nips 54,60 and transport it towards the stop arrangement 40 and barrier wall 42. The flat belts 53 preferably run over the entrance nip 56, 13 and ends just short of the right angle transport arrangement 20, which is before the stop arrangement 40. The flat belts 53 provide the last drive force to the paper after it has left the entrance nip 56,13 and also removes energy from the paper once it has contacted the wall 42 in the stop arrangement 20. The wall 42 is simply a flat stop for the paper to hit. The wall 42 is adjustable so that the downstream centerline of the machine can be maintained regardless of sheet length. Adjustment screws 43 are used for repositioning and fastening the wall 42 when it is moved to accommodate different sizes of paper.

In the preferred embodiment, there is a ceiling over the paper when it hits the wall 42. The ceiling may be comprised of several components including the flat belts 53, the upper guide 30 of the right angle transport arrangement 20, and an upper guide 41 of the stop arrangement. The ceiling prevents the paper from buckling, and transfers the impact energy back along the sheet where friction from the overrunning belts 53 can safely dissipate the energy. In addition, the belts 53 prevent the paper from bouncing back from the wall, and maintain a constant positive urge force on the sheets that keeps them registered against the wall 42. Such registration is beneficial for downstream processing.

The flat belts 53 are designed to slide over the surface of transported sheets, and do not positively engage sheets. Accordingly, the belts 53 are positioned directly over the sheet transport path, but do not press down hard enough to become fully frictionally engaged with the sheets.

Since the flat belts 53 are only loosely positioned over the paper path, in some embodiments it may be desirable to bias the sheets against the belts 53, so that greater urging force is achieved. In particular, in the region downstream of the entrance nip set 56, 13, where there are no nips to drive the sheet towards the wall, an upwardly biased guide plate 18 may be positioned, as seen in FIGS. 3 and 4. Biased guide plate 18 is attached to the deck 15 at an upstream end, while the downstream portion is unattached and extends upward at an angle. When a sheet passes over biased guide plate 18 a normal force will be applied upward on the sheet towards the flat belts 53, causing a greater forward urging force to be applied to the sheet.

The right angle transport includes two sets of actuated roller assemblies, 20 and 20', as seen in FIG. 3. Each actuated roller assembly 20, 20' includes an actuator 20 to drive the raising and lowering of the actuated idler rollers 23. Each actuator 21 will be a double acting air cylinder with integrated manifold and double solenoid valve assembly, capable of sufficiently low actuation time and duty cycle to allow the module to process at 72,000 sheets/hour. The actuators 21 cause a horizontal motion in actuator shafts 22, which in turn cause the idler rollers 23 to pivot upward and downward around a pivot point.

Two additional photocells 62 are positioned just before the wall 42. These photocells 62 allow tracking of the incoming and outgoing sheets (at 90 degrees). The sensor 62 transitions also allow precise timing of the actuated idler rollers 23 of assemblies 20 and 20'. Incoming sheets pass under the raised actuated idler rollers 23 and hit the wall 42. Shortly after contact with the wall 42, the actuator 21 of the lead assembly 20 will squeeze the idler rollers 23 on top of driven constant velocity rollers 24 positioned slightly below the deck 15. The lead sheet will then be transported towards the downstream module.

The trail actuator 21 of assembly 20' will do the same for the trail sheet, after a small delay to allow a gap between the sheets. The trail sheet will be transported under special thin metal guides 16 that serve to protect it from the overhead belts 53, and also the next incoming lead sheet. This special guide 16 effectively separates a single paper path into two.

Fixed hard nips 19, 24 are positioned just outside the maximum paper width envelope on the deck. Once the trail sheet has entered these fixed nips 19, 24, the actuators 21, 21' will open to allow the next set of incoming sheets.

A single motor and drive train (not shown) will power the adjustable nips 54, 60, entrance nips 56, 13, and overhead belt rollers 51, 52 (all motion in the infeed direction). A second motor and drive train (not shown) will power the series of driven rollers 24 which include the actuated nips 23, 24 and exit nips 19, 24 (all motion in the outfeed direction).

In the embodiment shown in FIG. 3, two guide plates 16 are positioned side by side before the stop arrangement 40. The guide plate 16', on the left, is intended to protect sheets arriving from an alternate source coming from transverse direction 70, as shown in FIG. 3. Guide plates 16 and 16' are respectively loosely secured to the deck 15 by dowel pin pairs next to lifting knobs 17 and 17'.

Figure 5:
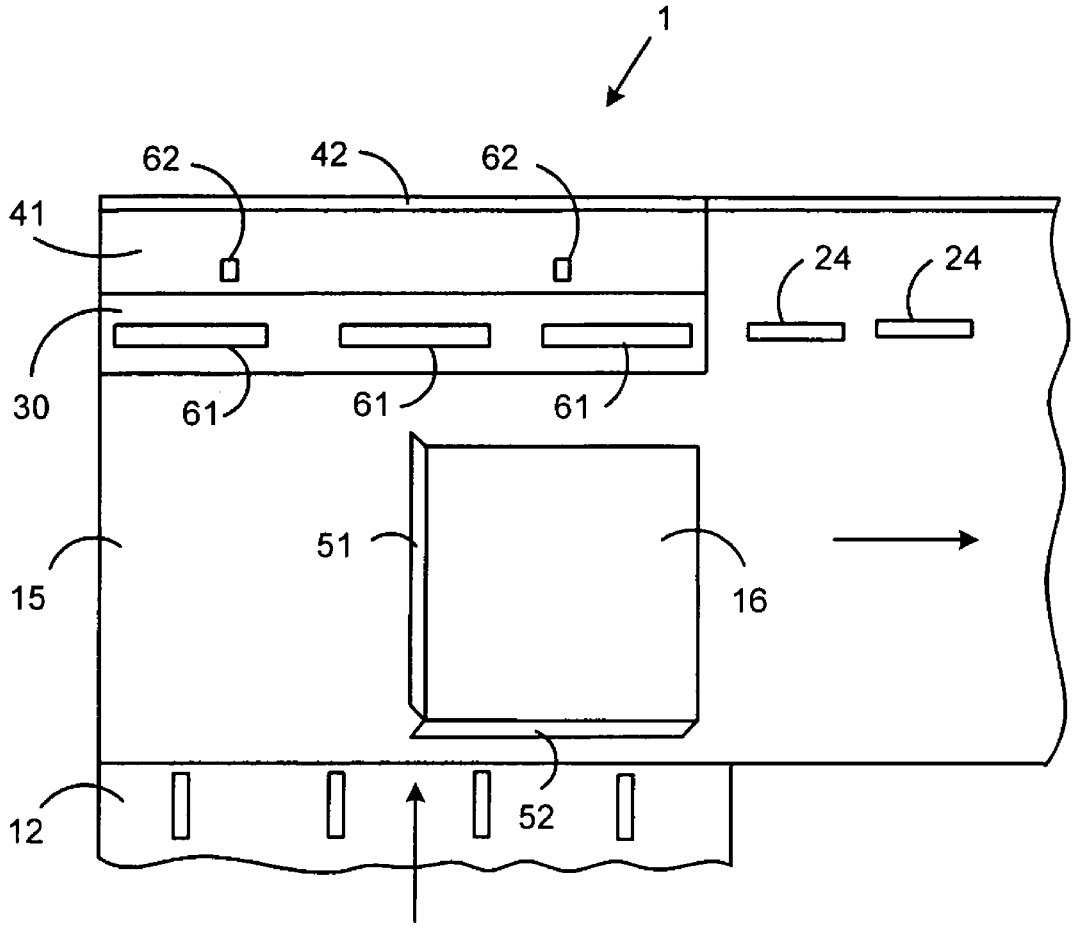
FIG. 5 is a top schematic view of the right angle turn module.

FIG. 5 depicts an overhead schematic view of right angle turn module 1 to assist in understanding the operation of the guide plate 16, and the manner in which it prevents collisions between incoming and outgoing sheets. Guide plate 16 includes a ramped portion 52 arranged to guide sheets over the guide plate 16 when arriving from deck 12. On a left side of the guide plate 16, an angled portion 51 is angled upward so that a right edge of a sheet passing to the left of the guide plate 16 can easily pass underneath the upward angled portion 51, without catching on an edge of the guide plate 16.

Figure 6A:
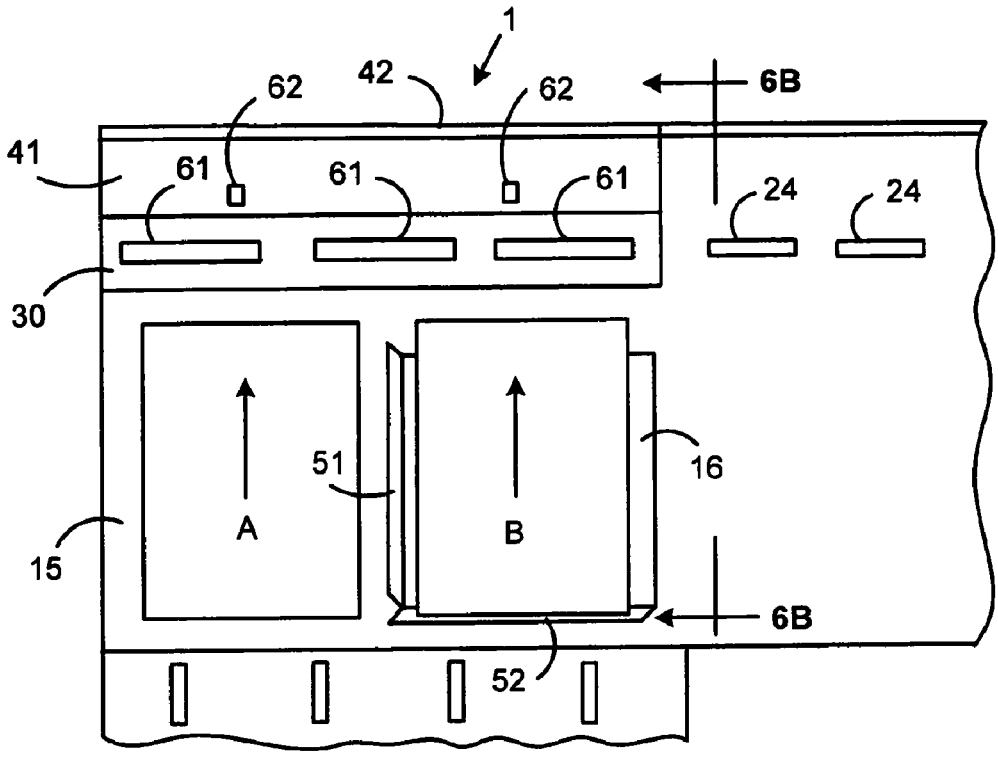
FIGS. 6A-6B, 7A-7B, 8A-8B and 9A-9B are top and side views of the right angle turn module as sheets are transported therein.
Figure 6B:
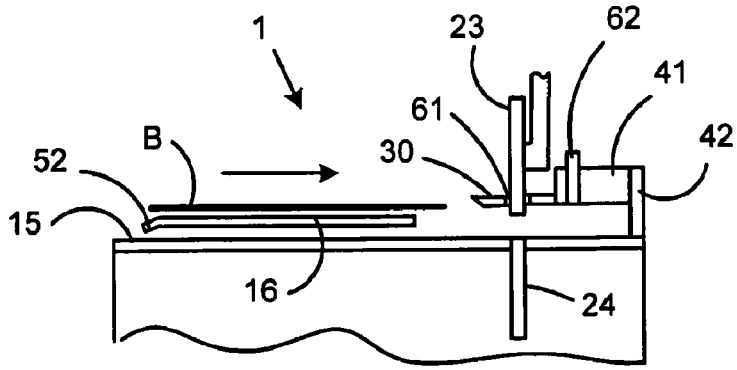

As seen in FIG. 6A sheets A and B are being transported towards the barrier wall 42. In this example sheet B is the lead sheet and sheet A is the trail sheet. Both sheets A and B are beyond the final nip set 56, 13, and are sliding over the deck 15 and/or guide 16 while being urged towards the barrier wall by the overhead belts 53. The side-view FIG. 6B shows sheet B passing over the guide plate 16, while sheet A passes over deck 15.

Figure 7A:
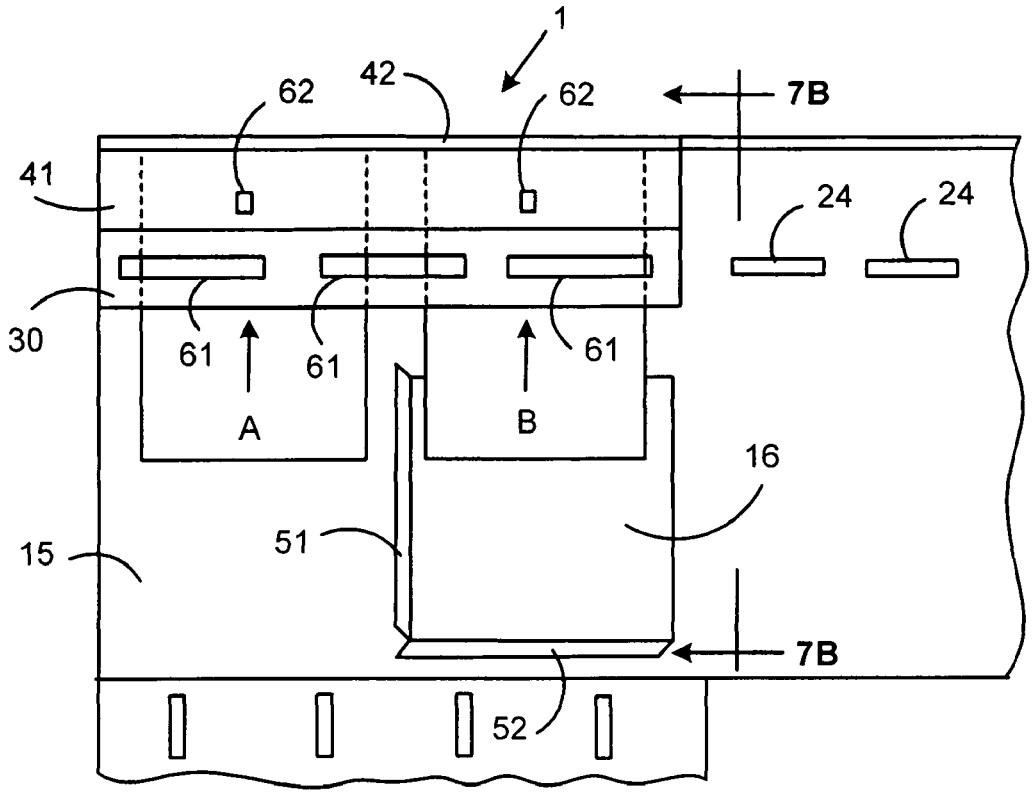
Figure 7B:
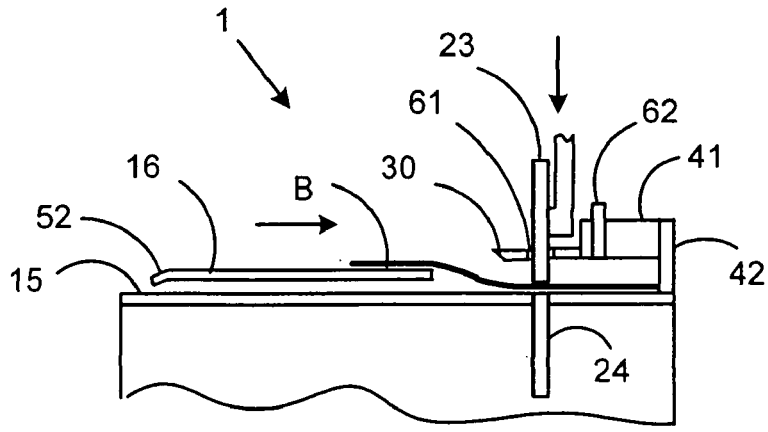

In FIG. 7A, sheets A and B are depicted just as they are contacting the barrier wall 42. As seen from the side view, FIG. 7B, the sheets have passed beneath the ceiling guide plate 30, the actuated idler roller 23 and the stop arrangement ceiling 41. Ceiling guide plate 30 includes slots 61 through which actuated rollers 23 are lowered and raised.

Figure 8A:
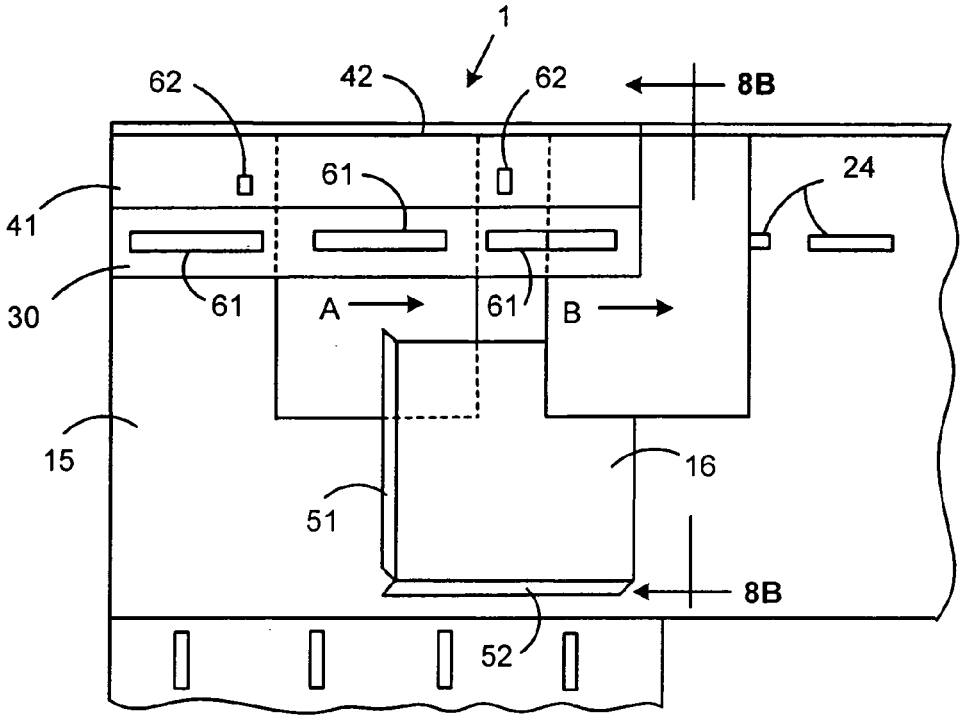
Figure 8B:
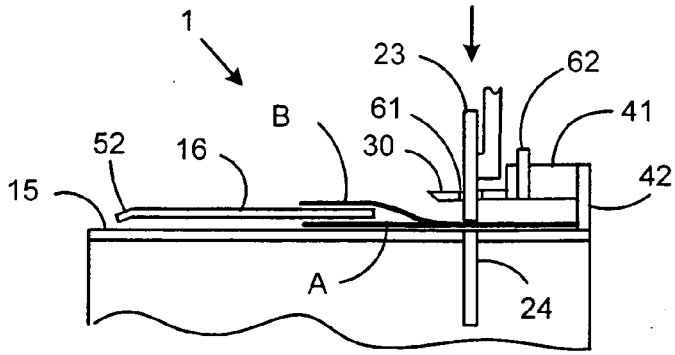

Next, in FIGS. 8A and 8B, the actuated idler rollers 23 have been pressed downward through slots 61, thus forming nips between upper rollers 23 and lower rollers 24. Sheets A and B are driven away at a right angle by the nips 23, 24. As seen in FIGS. 8A and 8B, the trail sheet A is guided to pass beneath the guide plate 16, while the lead sheet B continues to slide to the right on top of it. Upward angled portion 51 helps to ensure that the trail sheet A passes under the guide plate 16.

Figure 9A:
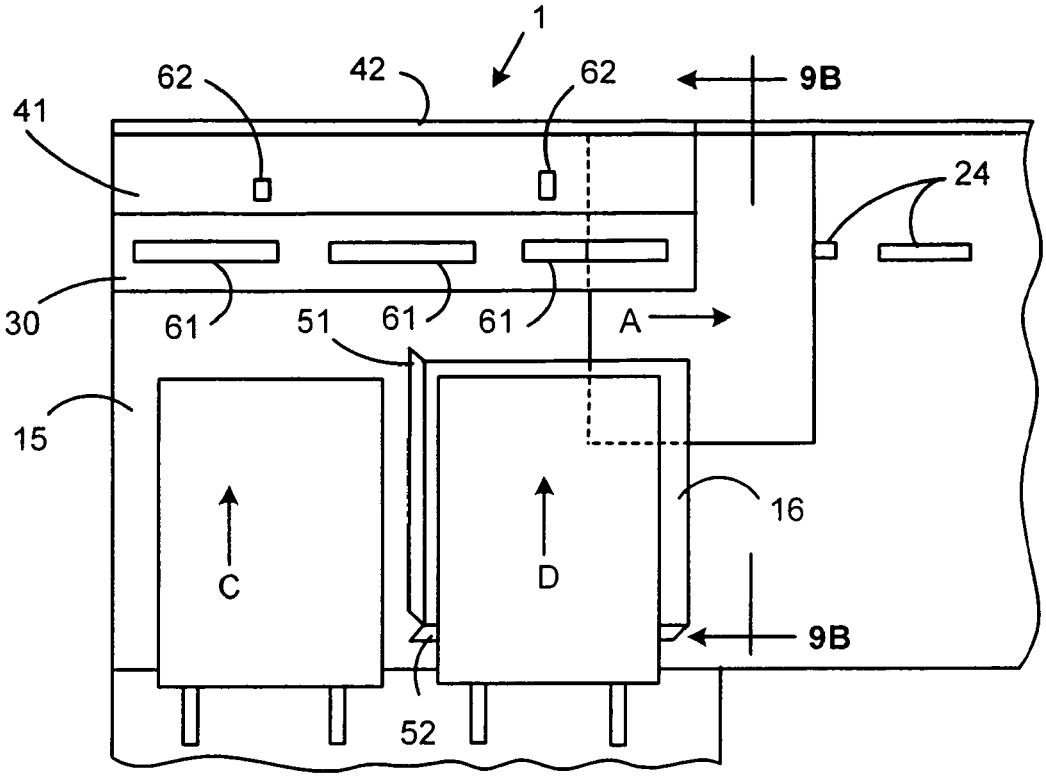
Figure 9B:
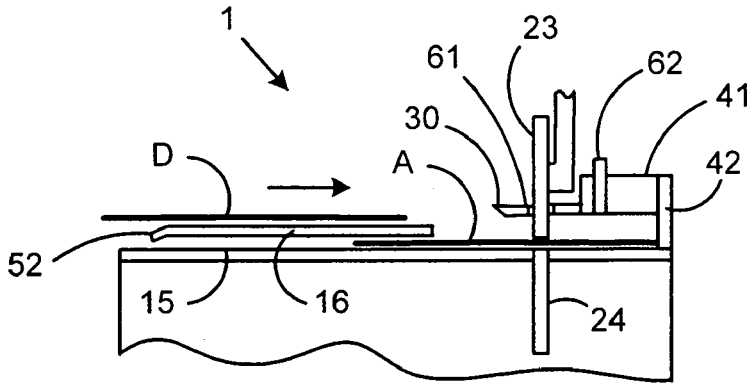
Figure 10:
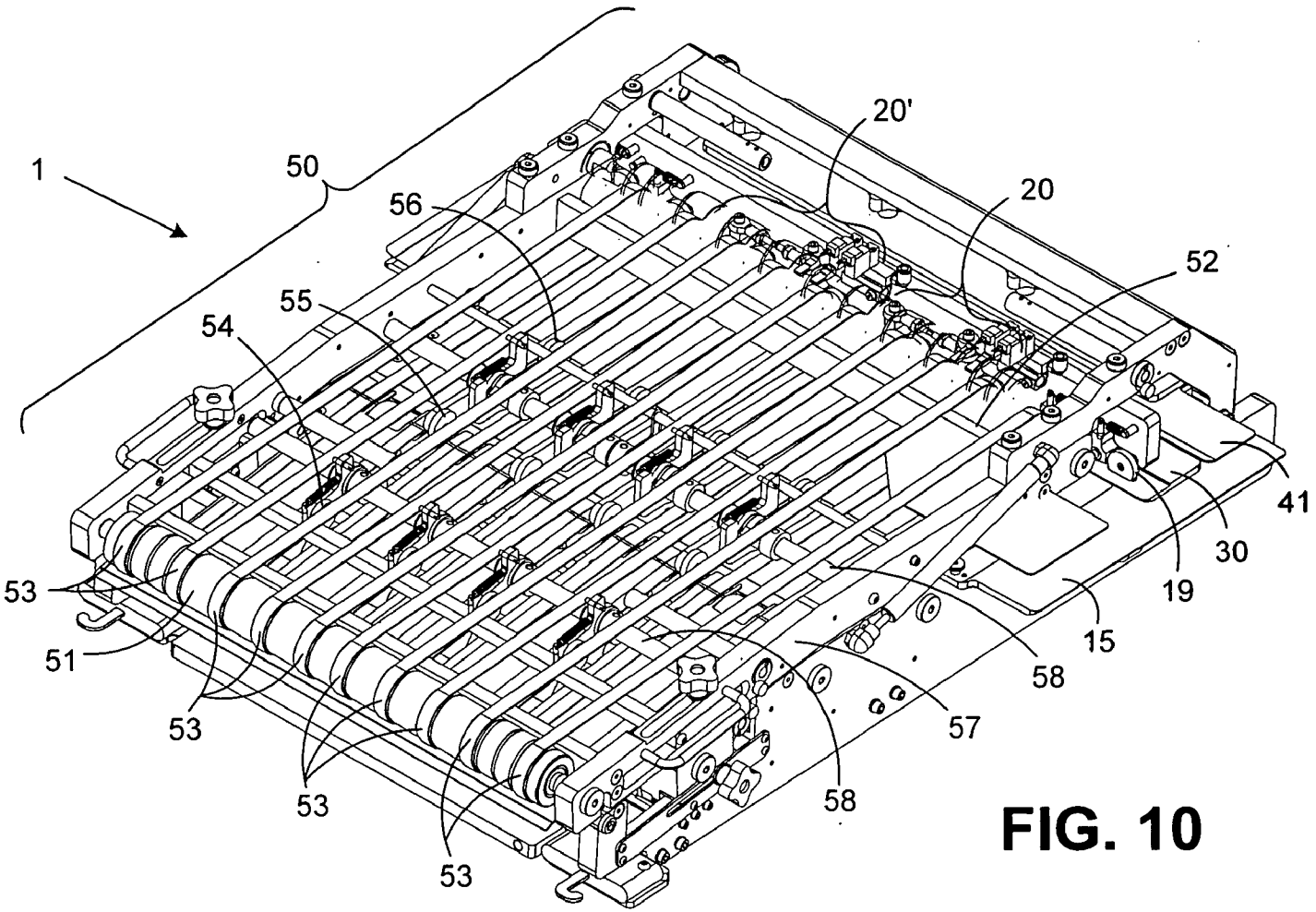
FIG. 10 is an isometric view of the right angle turn module with upper transport components depicted.
Figure 11:
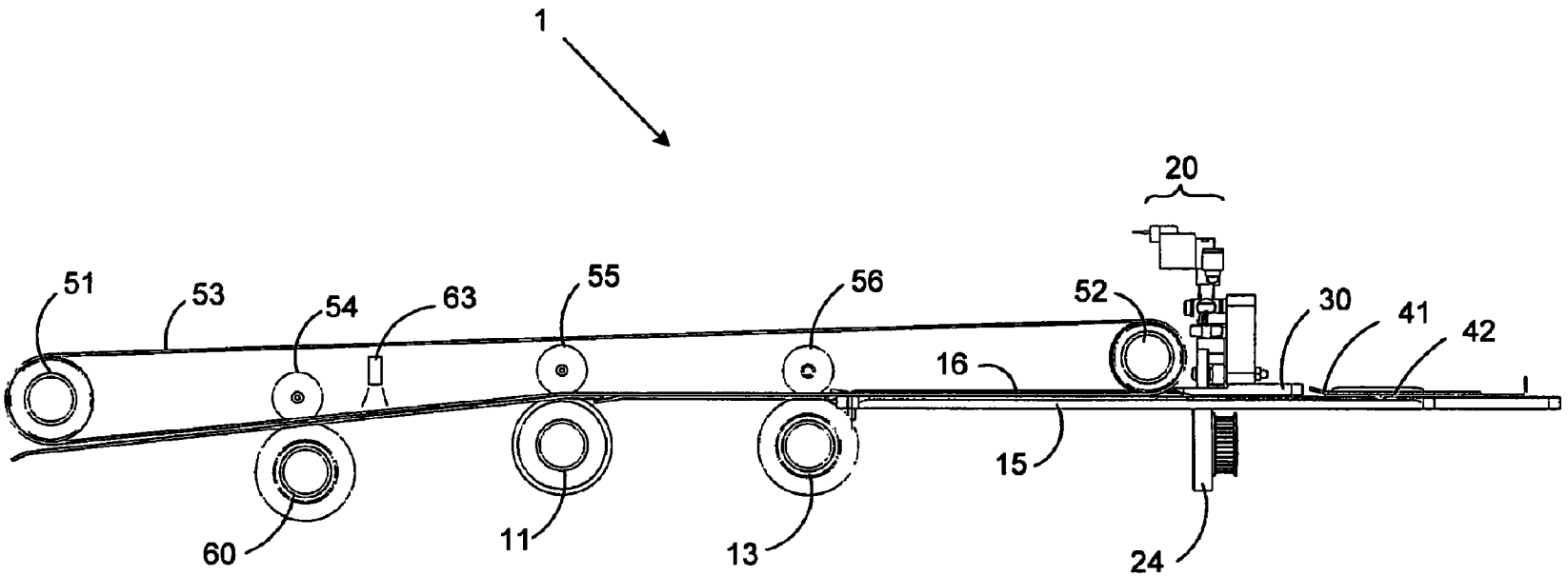
FIG. 11 is a side view of the right angle turn module.

In FIGS. 9A and 9B we see a second pair of sheets, C and D, arriving in the right angle turn module. It can be seen that the lead sheet D, of the second set of sheets, is positioned above the guide plate 16 while the trail sheet A, of the first set of sheets, is still passing under the guide plate 16. Immediately after sheet A has passed out from the control of the actuated rollers 23, the actuated rollers 23 are raised to allow the second set of sheets, C and D, to collide with the barrier wall 42.

Preferably, the guide plate 16 is made from a thin sheet of spring steel 0.01 inches thick. Being so thin, the plate 16 does not unduly weigh on the sheets passing underneath. Also, the thinness of the guide plate 16 insures that there is adequate room for sheets to pass over and under each other without unduly deflecting either of the sheets. For example, a thicker plate might require a more sever deflection in order for a sheet to pass over it, and thus create an opportunity for collision or jamming. The guide plate may range in thickness from 0.005 to 0.02 inches and maintain these same advantages. Also, a nickel coating on the steel can prevent wear and keep the guide plate smooth.

The biased guide plate 18 is also preferably made from a thin sheet of spring steel of a similar thickness. A thin sheet of spring steel has been found to maintain sufficient upward spring force for the use in biased plate 18.

Although the invention has been described with respect to preferred embodiments thereof, it will be understood by those skilled in the art that the foregoing and various other changes, omissions and deviations in the form and detail thereof may be made without departing from the spirit and scope of this invention.

What is claimed is:

1. A right angle turn module for transporting sheets, the module comprising:

a first sheet transport arranged to transport at least two sheets in a side-by-side arrangement in a first direction;

a stop arrangement, downstream of the first sheet transport, comprising a barrier positioned to stop travel of the two side-by-side sheets in the first direction;

a second sheet transport contiguous with the stop arrangement and arranged to transport the sheets serially in a second direction substantially perpendicular to the first direction; and a horizontal guide plate positioned at a downstream end of the first sheet transport and in a path of at least the side-by-side sheet on a downstream side in the second direction, whereby a sheet traveling in the first direction will pass over the guide plate on its way to the stop arrangement, and whereby after the sheets are being transported serially in the second direction, the downstream serial sheet will pass over the guide plate in the second direction and the upstream serial sheet will pass under the guide plate in the second direction.

2. The right angle turn module of claim 1 wherein the second transport is arranged to transport a first serial pair of sheets in the second direction, and simultaneously the first transport is arranged to transport a second side-by-side pair of sheets in the first direction, and wherein the guide plate is positioned such that an upstream sheet of the serial pair may be positioned underneath the guide plate while one sheet of the side-by-side pair, traveling in the first direction, is simultaneously positioned above the guide plate, thereby preventing a collision of sheets from the first and second pair.

3. The right angle turn module of claim 1 wherein the first transport further comprises overhead belts positioned at least above the guide plate to urge the side-by-side pair of sheets in the first direction.

4. The right angle turn module of claim 3 wherein the overhead belts are tensioned so as to slip over a top surface of the side-by-side pair of sheets while urging the pair of sheets towards the stop arrangement.

5. The right angle turn module of claim 4 wherein the overhead belts operate continuously, and whereby they operate to align serial sheets towards the stop while traveling in the second direction.

6. The right angle turn module of claim 3 further comprising an upwardly biased plate positioned above the horizontal guide plate, whereby a sheet traveling in the first direction will pass over the upwardly biased plate on its way to the stop arrangement, and whereby the upwardly biased plate provides a normal force to press at least one of the side-by-side sheets to contact with the overhead belts.

7. The right angle turn module of claim 1 further comprising a ceiling arrangement positioned above a paper path of the first and second transports, immediately upstream of the stop arrangement in the first direction, the ceiling arrangement positioned to help guide sheets transported by the first and second transports, and to prevent the sheets from buckling when the sheets impact with the stop arrangement.

8. The right angle turn module of claim 1 further comprising:

a sensor device arranged to detect an arrival of the side-by-side sheets at the stop arrangement; and wherein the second sheet transport is actuated to engage the sheets in the second direction when triggered by the sensing device sensing the arrival of the side by side sheets at the stop arrangement.

9. The right angle turn module of claim 8 wherein the actuated second sheet transport comprises lower driven rollers and upper idler rollers whereby the upper idler rollers are movably mounted to be raised and lowered, and whereby when the actuated second sheet transport is triggered the upper idler rollers are lowered to operate in engagement with the lower driven rollers.

10. The right angle turn module of claim 9 wherein upper idler rollers of the second sheet transport comprise an upstream idler roller and a downstream idler roller, and wherein the actuated idler rollers are controlled such that the downstream idler roller is lowered before the upstream idler is lowered in order to create spacing between the sheets in the second direction.

11. The right angle turn module of claim 1 wherein the stop arrangement includes an adjustable back wall that is adjustable in the first direction to accommodate different sized sheets.

12. The right angle turn module of claim 11 further comprising a sensor device arranged to detect an arrival of the side-by-side sheets at the stop arrangement; and wherein the second sheet transport is actuated to engage the sheets in the second direction when triggered by the sensing device sensing the arrival of the side by side sheets at the stop arrangement, and wherein an actuation trigger of the actuated second sheet transport includes a timing correction to account for a variation in position of the adjustable back wall relative to the sensor device.

13. The right angle turn module of claim 1 wherein the guide plate is a first of two guide plates and wherein a second guide plate is positioned upstream from the first guide plate, whereby a sheet traveling in the first direction will pass over the second guide plate on its way to the stop arrangement, and whereby after the sheets are being transported serially in the second direction, the upstream serial sheet will pass over the second guide plate in the second direction and a third sheet from upstream of the right angle turn module will pass under the second guide plate in the second direction.

14. The right angle turn module of claim 1 wherein the horizontal guide plate is comprised of thin sheet of spring steel with a thickness in a range of 0.005 to 0.02 inches.

15. A right angle turn module for transporting sheets, the module comprising:

a first sheet transport arranged to transport at least two sheets in a side-by-side arrangement in a first direction, the first transport including overhead belts positioned above a transport path to urge the side-by-side pair of sheets in the first direction;

a stop arrangement, downstream of the first sheet transport, comprising a barrier positioned to stop the travel of the two side-by-side sheets in the first direction;

a sensor device arranged to detect an arrival of the side-by-side sheets at the stop arrangement; and an actuated second sheet transport, triggered by the sensor device sensing the arrival of the side-by-side sheets at the stop arrangement, and when triggered, arranged to transport the sheets serially in a second direction substantially perpendicular to the first direction.

16. The right angle turn module of claim 15 wherein the overhead belts are configured to slip over a top surface of the side-by-side pair of sheets while urging the pair of sheets towards the stop arrangement; and wherein the overhead belts operate continuously, and whereby they operate to align serial sheets towards the stop while traveling in the second direction.

17. The right angle turn module of claim 15 further comprising an upwardly biased plate downstream of the first sheet transport, whereby a sheet traveling in the first direction will pass over the upwardly biased plate on its way to the stop arrangement, and whereby the upwardly biased plate provides a normal force to press at least one of the side-by-side sheets to contact with the overhead belts.

18. The right angle turn module of claim 15 further comprising a ceiling arrangement positioned above a paper path of the first and second transports, immediately upstream of the stop arrangement in the first direction, the ceiling arrangement positioned to help guide sheets transported by the first and second transports, and to prevent the sheets from buckling when the sheets impact with the stop arrangement.

19. The right angle turn module of claim 15 wherein the actuated second sheet transport comprises lower driven rollers and upper idler rollers whereby the upper idler rollers are movably mounted to be raised and lowered, and whereby when the actuated second sheet transport is triggered the upper idler rollers are lowered to operate in engagement with the lower driven rollers.

20. The right angle turn module of claim 19 wherein upper idler rollers of the second sheet transport comprise an upstream idler roller and a downstream idler roller, and wherein the actuated idler rollers are controlled such that the downstream idler roller is lowered before the upstream idler is lowered in order to create spacing between the sheets in the second direction.

21. The right angle turn module of claim 15 wherein the stop arrangement includes an adjustable back wall that is adjustable in the first direction to accommodate different sized sheets.

22. The right angle turn module of claim 21 wherein the actuation trigger of the actuated second sheet transport includes a timing correction to account for a variation in position of the adjustable back wall relative to the sensor device.

23. A right angle turn module for transporting sheets, the module comprising:

a first sheet transport arranged to transport at least two sheets in a side-by-side arrangement in a first direction;

a stop arrangement, downstream of the first sheet transport, comprising a barrier positioned to stop the travel of the two side-by-side sheets in the first direction;

a sensor device arranged to detect an arrival of the side-by-side sheets at the stop arrangement;

an actuated second sheet transport, triggered by the sensor device sensing the arrival of the side-by-side sheets at the stop arrangement, and when triggered, arranged to transport the sheets serially in a second direction substantially perpendicular to the first direction; and a ceiling arrangement positioned above a paper path of the first and second transports, immediately upstream of the stop arrangement in the first direction, the ceiling arrangement positioned to help guide sheets transported by the first and second transports, and to prevent the sheets from buckling when the sheets impact with the stop arrangement.

24. The right angle turn module of claim 23 wherein the actuated second sheet transport comprises lower driven rollers and upper idler rollers whereby the upper idler rollers are movably mounted to be raised and lowered, and whereby when the actuated second sheet transport is triggered the upper idler rollers are lowered to operate in engagement with the lower driven rollers.

25. The right angle turn module of claim 24 wherein the upper idler rollers of the second sheet transport comprise an upstream idler roller and a downstream idler roller, and wherein the actuated idler rollers are controlled such that the downstream idler roller is lowered before the upstream idler is lowered in order to create spacing between the sheets in the second direction.

26. The right angle turn module of claim 23 wherein the ceiling arrangement includes slots through which the upper idler rollers are positioned to be raised and lowered.

27. The right angle turn module of claim 23 wherein the stop arrangement includes an adjustable back wall that is adjustable in the first direction to accommodate different sized sheets.

28. The right angle turn module of claim 27 wherein the actuation trigger of the actuated second sheet transport includes a timing correction to account for a variation in position of the adjustable back wall relative to the sensor device.

* * * * *